United States Patent [19]

Block et al.

[11] Patent Number: 4,730,567

[45] Date of Patent: Mar. 15, 1988

[54] COMPOSITE FEED DOG FOR A SEWING MACHINE

[75] Inventors: William M. Block, Staten Island, N.Y.; William J. Edwards, Cranbury, N.J.; Charles R. Odermann, Montville, N.J.; Thaddeus J. Zylbert, Morris Plains, N.J.

[73] Assignee: SSMC Inc., Shelton, Conn.

[21] Appl. No.: 313,055

[22] Filed: Oct. 19, 1981

[51] Int. Cl.[4] ..... D05B 27/02

[52] U.S. Cl. ..... 112/324

[58] Field of Search ..... 112/322, 324

[56] References Cited

U.S. PATENT DOCUMENTS 2,307,513 1/1943 Kessler ..... 112/324

FOREIGN PATENT DOCUMENTS 1729493 6/1956 Fed. Rep. of Germany .

6810859 5/1969 Fed. Rep. of Germany .

1761186 7/1971 Fed. Rep. of Germany .

973974 2/1951 France ..... 112/324

47-36757 12/1972 Japan .

362304 7/1962 Switzerland ..... 112/324

OTHER PUBLICATIONS

Translation of Swiss Pat. No. 362,304 to Meyer.

Bender, *Handbook of Foamed Plastics,* Lake Publishing Corp., Libertyville, Ill., 1965, pp. 127, 128, 136.

Encyclopedia Britannica, vol. 19, 1974, p. 1149.

Wright et al, Solid Polyurethane Elastomers, Maclaren and Sons, London, 1969, pp. 247 through 254, 272, 273, 302.

*Primary Examiner*—W. C. Reynolds

*Attorney, Agent, or Firm*—Robert E. Smith

[57] ABSTRACT

A composite feed dog for a sewing machine comprises a zinc die cast body portion having a toothed surface region covered by a layer of elastomeric material.

9 Claims, 4 Drawing Figures

COMPOSITE FEED DOG FOR A SEWING MACHINE

DESCRIPTION

BACKGROUND OF THE INVENTION

This invention relates to sewing machines and, more particularly, to an improved feed dog for use therein.

The particular construction of the feed dog utilized in a sewing machine has a significant effect upon the appearance of the stitched work fabric. Thus, for example, a flat steel urethane coated feed dog causes more pucker than a toothed steel feed dog. However, the use of a toothed steel feed dog creates a problem when handling delicate fabrics and, additionally, a toothed steel feed dog is incompatible with a one step buttonhole presser foot having a thin steel underplate.

It is therefore an object of the present invention to provide an improved feed dog which is compatible with the use of a one step buttonhole presser foot, which may be used with delicate fabrics, and wherein the amount of pucker is at or below an acceptable level.

SUMMARY OF THE INVENTION

The foregoing and additional objects are attained in accordance with the principles of this invention by providing a feed dog for a sewing machine comprising a hardened body portion having a roughened surface region and a layer of elastomeric material covering all of the surface region to at least a predetermined minimum depth to define a work engaging plane surface.

In accordance with an aspect of this invention, the body portion is formed as a zinc die casting, the roughened surface thereof is formed with teeth, and the elastomeric layer is a thermoset polyurethane having a durometer hardness of about 80 units on the Shore A scale.

BRIEF DESCRIPTION OF THE DRAWINGS

The foregoing will be more readily apparent upon reading the following description in conjunction with the drawings wherein.

DETAILED DESCRIPTION

Figure 1:
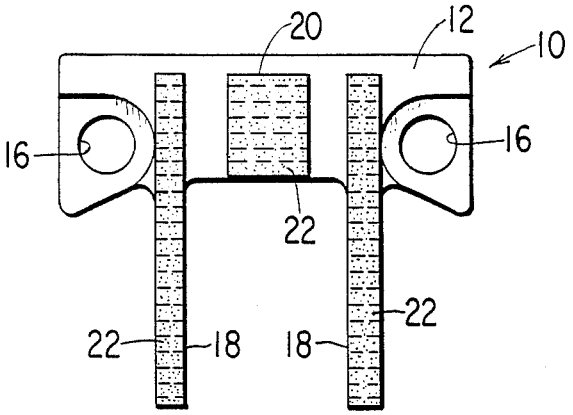
FIG. 1 is a top plan view of an improved feed dog constructed in accordance with the principles of this invention.
Figure 2:
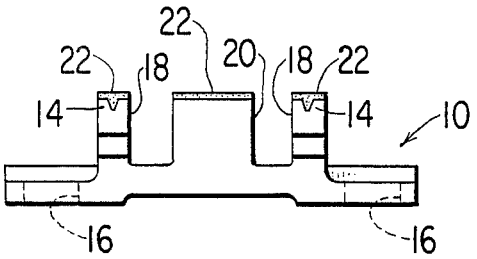
FIG. 2 is a front elevational view of the feed dog of FIG. 1.
Figure 3:
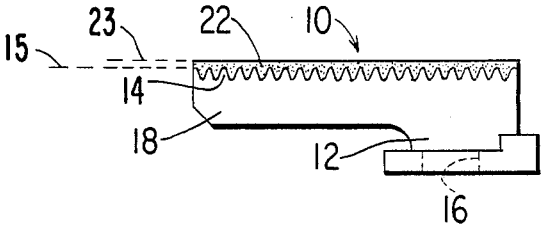
FIG. 3 is a side elevational view of the feed dog of FIG. 1.

Referring to the drawings, wherein like elements in different figures thereof have the same reference character applied thereto, FIGS. 1, 2 and 3 illustrate top, front and side views of an improved composite feed dog, designated generally by the reference character 10, constructed in accordance with the principles of this invention. The feed dog 10 includes a hardened body portion 12 having a roughened surface region preferably formed with teeth 14, the tips of which define a first plane 15. The body portion 12 is preferably formed as die cast zinc and has a pair of holes 16 used for attaching the feed dog 10 to the feed bar of a sewing machine, by screws or the like.

As is conventional, the feed dog 10 has three regions which extend through appropriate openings in the bed of the sewing machine to engage the work fabric in order to feed the work fabric between needle penetrations. These three regions are the two elongated areas 18 and the substantially rectangular centrally located area 20. The teeth 14 cover these three work engaging areas.

Figure 4:
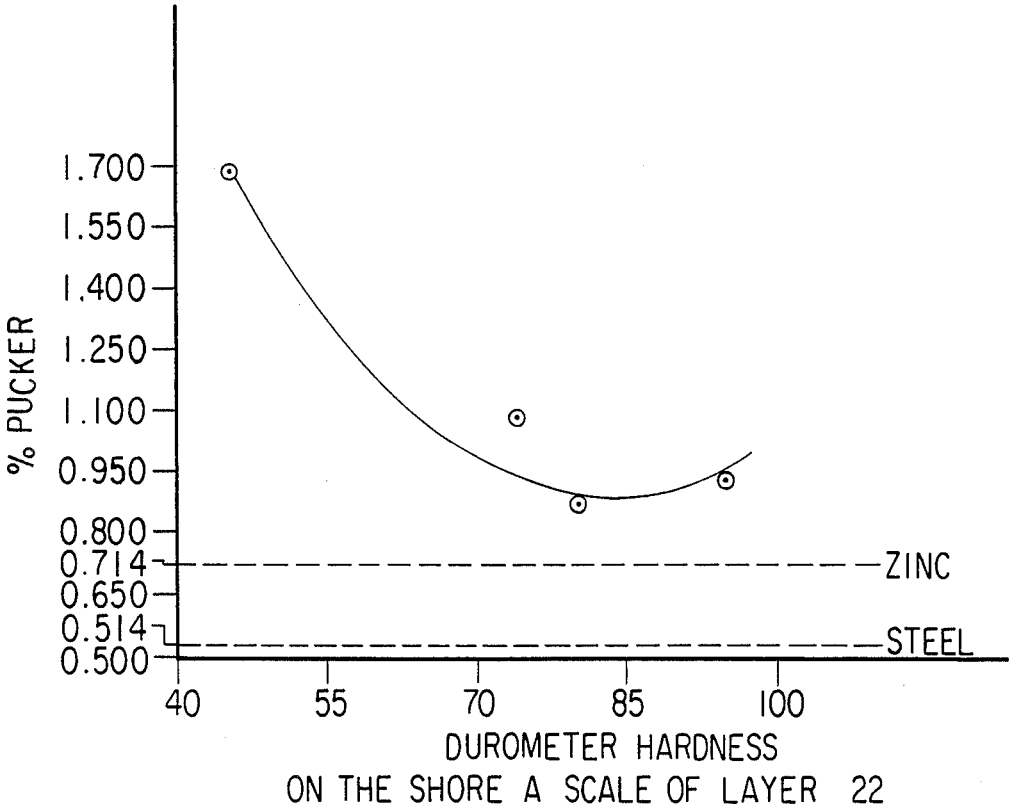
FIG. 4 is a graph, based upon experimental test results, of fabric pucker versus the hardness of the elastomeric layer of a feed dog constructed in accordance with the principles of this invention.

In accordance with the principles of this invention, a layer of elastomeric material 22 covers the teeth 14 to at least a predetermined minimum depth above the tips of the teeth 14 so as to define a work engaging plane surface 23. In a preferred embodiment of this invention, the elastomeric layer is formed from a thermoset polyurethane which is typically formed from the reaction of an isocyanate-terminated polyester and a hydroxyl-terminated polyether. The depth of the elastomeric layer 22 between the first plane 15 defined by the tips of the teeth 14 to the work engaging plane surface 23 is preferably in the range from about 0.050 mm to about 0.455 mm with a preferred depth of approximately 0.255 mm. The elastomeric layer 22 may be formed of a polyurethane having different degrees of hardness. In order to obtain an optimum hardness characteristic, tests were performed to measure the effect of the hardness of the layer 22 on pucker of a sewn fabric. The result of these tests are shown in FIG. 4. Utilizing feed dogs where the elastomeric layer 22 had durometer hardnesses of 45 (as measured on the Shore A scale), 74, 80, and 95, straight stitching was performed on a variety of fabrics between two lines drawn on the fabric 18 inches apart. The amount of foreshortening of the fabric after sewing was measured to determine the amount of fabric pucker. For each of the feed dogs, the amount of pucker was averaged for the different fabrics. In addition, measurements were taken utilizing both an all-zinc feed dog and an all-steel feed dog. The results of these tests are shown in FIG. 4. For the composite feed dog, it is seen that optimum results are attained when the durometer hardness of the elastomeric layer 22 is between about 70 and 95, with 80 being a preferred hardness.

In addition to the polyurethane for forming the elastomeric layer 22, fillers are preferably added to the polyurethane before it is applied to the body portion 12 in order to add viscosity and pigmentation to the polyurethane. A preferred polyurethane is Flexane 80 liquid manufactured by Devcon Corporation of Danvers, Mass. As fillers, it is preferred to utilize JT Baker talc, grade U.S.P., manufactured by Baker Chemical Company of Phillipsburg, N.J., to add viscosity and United Carbon Black, grade N-330, manufactured by Ashland Chemical Company of Akron, Ohio, for pigmentation. A preferred procedure for applying the elastomeric layer 22 to the teeth 14 is to first combine in a clean dry container equipped with a mechanical stirrer, 5 parts of the Flexane 80 liquid, 5 parts of the Baker talc, and 0.5 parts of the United Carbon Black. This mixture is stirred until it is uniform in color and consistency and it is desirable to avoid entraining the air during mixing. The mixture is then allowed to stand in a sealed container overnight to permit air to rise and dissipate. Immediately prior to use, the 10.5 parts of the mixture are combined in a clean dry container with 1.5 parts of Flexane 80 liquid curing agent, and the resulting mixture is mechanically stirred for 2 minutes. This final mixture is then applied to the teeth 14 through a stencil having apertures to accept the regions 18 and 20 therethrough.

Accordingly, there has been disclosed an improved composite feed dog for a sewing machine. This feed dog has been found to afford a significant cost advantage over toothed steel feed dogs or flat steel feed dogs with urethane coatings applied thereon by a compression molding process. In addition, this feed dog exhibits enhanced performance. Although the reasons for the differences in pucker performance are not completely understood, it is speculated that the configurations that perform the best must hold the fabric and the line of stitching more firmly during the stitch setting and feeding process, precluding the feedback forces from pulling previously set stitches and movement of the fabric both along the line of stitching, transverse to the line of stitch and relative movement between the plies of fabric being sewn. By using a serrated metal insert substrate on which the urethane coating is applied, the composite compliance is reduced in the "lift" and "feed" axes. At the same time, the coefficient of friction of the feed dog on the fabric is not adversely effected.

It is understood that the above-described embodiment is merely illustrative of the application of the principles of this invention, and it is only intended that this invention be limited by the scope of the appended claims.

We claim:

1. A feed dog for a sewing machine comprising:

a hardened body portion having a roughened surface region; and a layer of elastomeric material covering all of said surface region to at least a predetermined minimum depth to define a work engaging plane surface.

2. The feed dog according to claim 1 wherein said roughened surface is formed with teeth, the tips of which lie in a plane, and the depth of said layer between said tip plane and said work engaging plane surface is in the range from about 0.050 mm to about 0.455 mm.

3. The feed dog according to claim 2 wherein said depth is approximately 0.255 mm.

4. The feed dog according to claim 1 wherein said elastomeric layer is a thermoset polyurethane formed from the reaction of an isocyanate-terminated polyester and a hydroxyl-terminated polyether.

5. The feed dog according to claim 4 wherein said polyurethane has a durometer hardness in the range from about 70 to about 95 units on the Shore A scale.

6. The feed dog according to claim 5 wherein said polyurethane has a durometer hardness of about 80 units on the Shore A scale.

7. The feed dog according to claims 4, 5 or 6 wherein said body portion is formed as a zinc die casting.

8. The feed dog according to claim 4 wherein said polyurethane has added thereto a mixture of talc and carbon black.

9. A feed dog for a sewing machine comprising:

a zinc die cast body portion having a surface region with teeth, the tips of which define a first plane; and a layer of polyurethane of a durometer hardness of about 80 units on the Shore A scale covering said teeth to a thickness of about 0.255 mm from said first plane to a work engaging plane surface.

* * * * *